US010743381B2

(12) United States Patent
Mensch et al.

(10) Patent No.: US 10,743,381 B2
(45) Date of Patent: Aug. 11, 2020

(54) DIMMER

(71) Applicant: Siemens Schweiz AG, Zürich (CH)

(72) Inventors: Johann Mensch, Regensburg (DE); Jakob Reislhuber, Mötzing (DE)

(73) Assignee: SIEMENS SCHWEIZ AG, Zurich (CH)

( * ) Notice: Subject to any disclaimer, the term of this patent is extended or adjusted under 35 U.S.C. 154(b) by 0 days.

(21) Appl. No.: 16/701,699

(22) Filed: Dec. 3, 2019

(65) Prior Publication Data

US 2020/0196408 A1 Jun. 18, 2020

(30) Foreign Application Priority Data

Dec. 17, 2018 (DE) ..... 10 2018 009 924

(51) Int. Cl.
*H05B 33/08* (2020.01)
*H05B 45/14* (2020.01)
*H05B 45/31* (2020.01)

(52) U.S. Cl.
CPC ..... *H05B 45/14* (2020.01); *H05B 45/31* (2020.01)

(58) Field of Classification Search
CPC ..... H05B 33/0815; H05B 33/0827; H05B 33/0845; H05B 33/0848; H05B 33/0878
USPC ..... 315/292, 317, 318
See application file for complete search history.

(56) References Cited

U.S. PATENT DOCUMENTS 3,284,667 A * 11/1966 Harris ..... H05B 41/3924 315/195
6,046,550 A * 4/2000 Ference ..... H05B 37/02 315/291
2003/0043027 A1* 3/2003 Carson ..... H04B 3/54 375/259
2007/0296347 A1* 12/2007 Mosebrook ..... H05B 37/0209 315/209 SC
2011/0121744 A1* 5/2011 Salvestrini ..... H05B 45/50 315/246
2016/0044758 A1* 2/2016 Arulandu ..... H05B 45/37 315/129

(Continued)

FOREIGN PATENT DOCUMENTS

DE 102017215643 B3 7/1918 ..... H05B 37/02
DE 102006013518 B3 9/2007 ..... G05F 1/455

(Continued)

*Primary Examiner* — Tung X Le
(74) *Attorney, Agent, or Firm* — Slayden Grubert Beard PLLC

(57) ABSTRACT

Various embodiments include a dimmer for controlling the power consumption of a connectable load. The dimmer includes: two parallel-connected, electrically isolated dimmer channels with control devices; a main control device for the channels; a communication link from the main control device to the channel control devices; and a communication link transmitting information from a first dimmer channel to a second dimmer channel. At least one of the two dimmer channels comprises a measurement device generating information about behavior of the electricity at a location in the measurement dimmer channel. The communication link transmits that information. Starting from the measurement dimmer channel, a channel communication link leads in each case from one dimmer channel to the next dimmer channel. The dimmer determines whether respective times of respective zero crossings of a sinusoidal AC voltage applied to the respective dimmer channel are substantially synchronous.

21 Claims, 9 Drawing Sheets

(56) References Cited

U.S. PATENT DOCUMENTS

| | | | | |
|---|---|---|---|---|
| 2016/0134187 | A1* | 5/2016 | Pregitzer | H02M 3/156<br>323/285 |
| 2017/0308048 | A1* | 10/2017 | Weber | G06F 13/4282 |

FOREIGN PATENT DOCUMENTS

| | | | | |
|---|---|---|---|---|
| DE | 10 2016 209 278 | B3 | 8/2017 | H05B 37/02 |
| DE | 10 2017 213 888 | B3 | 10/2018 | H05B 37/02 |
| EP | 2 925 095 | A1 | 9/2015 | H05B 37/02 |

* cited by examiner

DIMMER

CROSS-REFERENCE TO RELATED APPLICATIONS

This application claims priority to DE Application No. 10 2018 009 924.6 filed Dec. 17, 2018, the contents of which are hereby incorporated by reference in their entirety.

TECHNICAL FIELD

The present disclosure relates to electrical circuits. Various embodiments include dimmers, e.g. a device for controlling the electrical power consumption of an electrical load, in particular an integrated or connectable lighting device.

BACKGROUND

Dimmers are generally known and serve to vary electrical power. Power variation using dimmers may be achieved by leading-edge phase control or by trailing-edge phase control. In leading-edge phase control, the current is switched on with delay after the zero crossing of the AC voltage and flows to the next current zero crossing. It is typically used in the case of an inductive load response. In trailing-edge phase control, on the other hand, the current is switched on immediately after the zero crossing and switched off again before the next zero crossing. This is typically used in the case of a capacitive load response. To generate the control commands required therefor for its switching components, the dimmer has a main control device.

Some dimmers are described as "multichannel dimmers". These have a plurality of individual dimmers, which each control part of the electrical load. To increase power, these "dimmer channels" are connectable on the output side in parallel, sequentially or in a mixture of ways. A plurality of physical channels are interconnected and a powerful logical channel is obtained. The dimmer channels may here be in one device or indeed in a plurality of devices.

It is important, however, because of this interconnection, that the outputs of the dimmer channels are largely synchronized. If, for example, two channels were connected in parallel and the second channel switches too late (leading-edge phase) or too early (trailing-edge phase), the first channel is overloaded to a greater extent than if both switch incorrectly but synchronously. This may lead to overheating or to failure of the first dimmer channel, or even to disconnection of the dimmer.

In known multichannel dimmers, each dimmer channel has its own channel control device, e.g. a processor, and a measurement device for measuring the electricity in the channel, which may sometimes also be formed by this processor. Using the measurement device, the channel control device receives the information about the periodic behavior of the electricity in the channel which is needed to identify the leading-edge phase or the trailing-edge phase. The control commands generated by the main control device are transmitted in each case via a communication link to the channel control devices of the dimmer channels and there implemented in accordance with the information about the periodic behavior of the electricity in the channel.

The complexity of the measurement devices in particular leads to high development and production costs. Inaccuracies in zero crossing identification may also arise as a result of component tolerances or due to component aging. The resultant time differences then lead to non-synchronous switching of the dimmer channels and to the above-described problems. Device replacement or recalibration of the components thereof is possible, but not without cost and optionally consequential damage due to malfunctioning.

German patent DE102017213888B3 describes a dimmer for controlling the power consumption of a connectable load, having at least two dimmer channels, wherein at least one dimmer channel is configured as a measurement dimmer channel for identifying the behavior of the electricity. To synchronize the dimmer channels, starting from the measurement dimmer channel a channel communication link leads in each case from one dimmer channel to the next dimmer channel.

German patent DE102016209278B3 describes a dimmer system for controlling the power consumption of a connectable load and a method for controlling the power consumption of a connectable load in a dimmer system, having a master control device and at least two slave dimmers, wherein the master control device outputs synchronization signals for synchronizing the respective outputs of the slave dimmers via a suitable communication link to the respective slave dimmers, and wherein the slave dimmers are connected in parallel in order to provide a jointly controlled output for the connectable load.

SUMMARY

Although the prior art dimmers and dimmer systems are suitable for phase-synchronous switching of multiple parallel physical channels or of slave dimmers, they still require manual verification as to whether the parallel connection of the dimmer channels has been correctly wired. The teachings of the present disclosure describe dimmers, in particular multichannel dimmers, a methods for simply identifying wiring errors when connecting the channels of the dimmer.

Various embodiments include a dimmer for controlling the power consumption of a connectable load, e.g. an LED light, having at least two parallel-connected, electrically isolated dimmer channels each with a channel control device, of which dimmer channels at least one is configured as a measurement dimmer channel comprising a measurement device which is at least suitable for generating information about the behavior of the electricity at a location in the measurement dimmer channel, a main control device, which is at least suitable for generating control commands for the dimmer channels, and a communication link, which is at least suitable for transmitting such control commands from the main control device to the channel control device of a dimmer channel, wherein the dimmer comprises at least one channel communication link which is at least suitable for transmitting information from a first dimmer channel to a second dimmer channel, and wherein the channel communication link is at least suitable for transmitting information about the behavior of the electricity at the location in the measurement dimmer channel, wherein starting from the measurement dimmer channel a channel communication link leads in each case from one dimmer channel to the next dimmer channel, and wherein the dimmer is set up to identify whether the respective times of the respective zero crossings of the sinusoidal AC voltage applied to the respective dimmer channel are substantially synchronous.

As an example, some embodiments include a dimmer (D) for controlling the power consumption of a connectable load, in particular an LED light, having at least two parallel-connected, electrically isolated dimmer channels (K1, K2, Kx, DK1-DKn) each with a channel control device (S1, S2, Sx), of which dimmer channels (K1, K2, Kx, DK1-DKn) at least one (K1) is configured as a measurement dimmer channel (K1) comprising a measurement device (M1) which is at least suitable for generating information about the behavior of the electricity at a location in the measurement dimmer channel, a main control device (H), which is at least suitable for generating control commands for the dimmer channels (K1, K2, Kx, DK1-DKn), and a communication link (V), which is at least suitable for transmitting such control commands from the main control device (H) to the channel control device (S1) of a dimmer channel (K1), characterized in that the dimmer (D) comprises at least one channel communication link (V12, V23, V(x−1)x) which is at least suitable for transmitting information from a first dimmer channel (K1, K2) to a second dimmer channel (K2, Kx), and the channel communication link (V12, V23, V(x−1)x) is at least suitable for transmitting information about the behavior of the electricity at the location in the measurement dimmer channel (K1), wherein, starting from the measurement dimmer channel (K1), a channel communication link (V12, V23, V(x−1)x) leads in each case from one dimmer channel to the next dimmer channel, wherein the dimmer (D) is set up to identify whether the respective times of the respective zero crossings of the sinusoidal AC voltage applied to the respective dimmer channel (K1, K2, Kx, DK1-DKn) are substantially synchronous.

In some embodiments, the channel communication link (V12, V23, V(x−1)x) is at least suitable for transmitting this information to the channel control device (S2, Sx) of the second dimmer channel (K2, Kx, DK1-DKn).

In some embodiments, this information contains an indication about the time of at least one zero crossing of the voltage at the location in the measurement dimmer channel (K1).

In some embodiments, the channel control device (S2, Sx) of the second dimmer channel (K2, Kx) is suitable, as a result of stored data, for generating information on the basis of this information about the behavior of the electricity at a location in the second dimmer channel (K2, Kx).

In some embodiments, the data includes a time value, which equates to an estimate of the time for processing and transmitting the information from the measurement dimmer channel (K1) as far as the control device of the second dimmer channel (K2, Kx).

In some embodiments, the information about the behavior of the electricity at the location in the second dimmer channel (K2, Kx) includes an indication about the time of at least one zero crossing of the voltage.

In some embodiments, the channel communication link (V12, V23, V(x−1)x) is at least also suitable for transmitting control commands from the main control device (H) from the channel control device (S1, S2) of the first dimmer channel (K1, K2) to the channel control device (S2, Sx) of the second dimmer channel (K2, Kx).

In some embodiments, the channel communication link (V1, V2, V(x−1)x) comprises an element for electrical isolation of the first dimmer channel (K1, K2) from the second dimmer channel (K2, Kx).

In some embodiments, the main control device (H) is a channel control device.

In some embodiments, the first dimmer channel is a different one from the measurement dimmer channel (K1).

In some embodiments, at least two channel communication links are suitable in each case for transmitting information about the behavior of the electricity in the measurement dimmer channel (K1) from the measurement dimmer channel (K1) to at least two other dimmer channels.

In some embodiments, the measurement dimmer channel (K1) is set up to identify whether the respective times of the respective zero crossings of the sinusoidal AC voltages applied to the respective dimmer channels (K1, K2, Kx, DK1-DKn) are substantially synchronous.

In some embodiments, each dimmer channel (K1, K2, Kx, DK1-DKn) is set up to identify whether the respective times of the respective zero crossings of the sinusoidal AC voltages applied to the respective dimmer channels (K1, K2, Kx, DK1-DKn) are substantially synchronous.

In some embodiments, each dimmer channel (K1, K2, Kx, DK1-DKn) is configured as a measurement dimmer channel (K1) with a respective measurement device (M1) and a respective communication link (V) to the main control device (H), wherein the main control device (H) is set up to identify whether the respective times of the respective zero crossings of the sinusoidal AC voltage applied to the respective dimmer channel (K1, K2, Kx, DK1-DKn) are substantially synchronous.

In some embodiments, in the event of identification that the respective times of the respective zero crossings of the sinusoidal AC voltages applied to the respective dimmer channels (K1, K2, Kx, DK1-DKn) are not synchronous, a corresponding indicator (I) is activatable at the dimmer.

As another example, some embodiments include a dimmer (D) for controlling the power consumption of a connectable load (L), in particular an LED light, having at least two parallel-connected, electrically isolated dimmer channels (DKa-DKx) each with one channel control device (SE1-SEx), wherein each of the dimmer channels (DKa-DKx) is configured as a measurement dimmer channel, with in each case one measurement device (M1), which is at least suitable for zero crossing identification (NDE) of the current applied to the respective dimmer channel (DKa-DKx) and/or the respectively applied voltage; a main control device (H), which is set up to obtain information about the zero crossings (ND) of the sinusoidal alternating currents and/or AC voltages applied to the respective dimmer channels (DKa-DKx) from the respective channel control devices (SE1-SEx) via suitable communication links (V, KV), and which is further set up to compare the items of information about the zero crossings (ND) of the respective dimmer channels (DKa-DKx) with one another, and which is further set up to generate control commands for the dimmer channels (DKa-DKx), wherein the control commands may be transmitted via the suitable communication links (V, KV) from the main control device (H) to the channel control devices (SE1-SEx) of the dimmer channels (DKa-DKx), characterized in that the main control device (H) is set up to identify whether the zero crossings of the dimmer channels (DKa-DKx) allocated for parallel operation are substantially synchronous.

In some embodiments, the main control device (H) in the dimmer (D) is configured as a separate device (e.g. microcontroller).

In some embodiments, the main control device (H) is integrated into a correspondingly set-up channel control device (SE1-SEx) of a dimmer channel (DKa-DKx).

In some embodiments, a channel control device (SE1-SEx) of one dimmer channel (DKa-DKx) is configured as the main control device (H) or master.

In some embodiments, identification as to whether the respective zero crossings (ND) of the sinusoidal alternating currents and/or AC voltages applied to the respective dimmer channels (DKa-DKx) are substantially synchronous proceeds by comparing the respective times of the zero crossings (ND) or by comparing the respective phase angles.

In some embodiments, in the event of identification that the respective times of the respective zero crossings (ND) of the sinusoidal alternating currents and/or AC voltages applied to the respective dimmer channels (DKa-DKx) are not synchronous, a corresponding indicator (I) is activatable at the dimmer (D).

As another example, some embodiments include a method for identifying correct wiring of at least two parallel-connected electrically isolated dimmer channels (K1, K2, Kx, DK1-DKn) of a dimmer, in particular a universal dimmer, wherein, for each dimmer channel (K1, K2, Kx, DK1-DKn), information about the times of the zero crossings of the sinusoidal AC voltage of the conductor connected thereto is provided as well as information about the zero crossings of the adjacent, parallel-connected channel; wherein, by measuring the phase shift of the two voltages, it is established whether or not an appreciable phase shift is present, wherein an identified phase shift represents incorrect wiring.

BRIEF DESCRIPTION OF THE DRAWINGS

The teachings of the present disclosure are further explained by way of example with reference to the following figures, in which.

DETAILED DESCRIPTION

Figure 1:
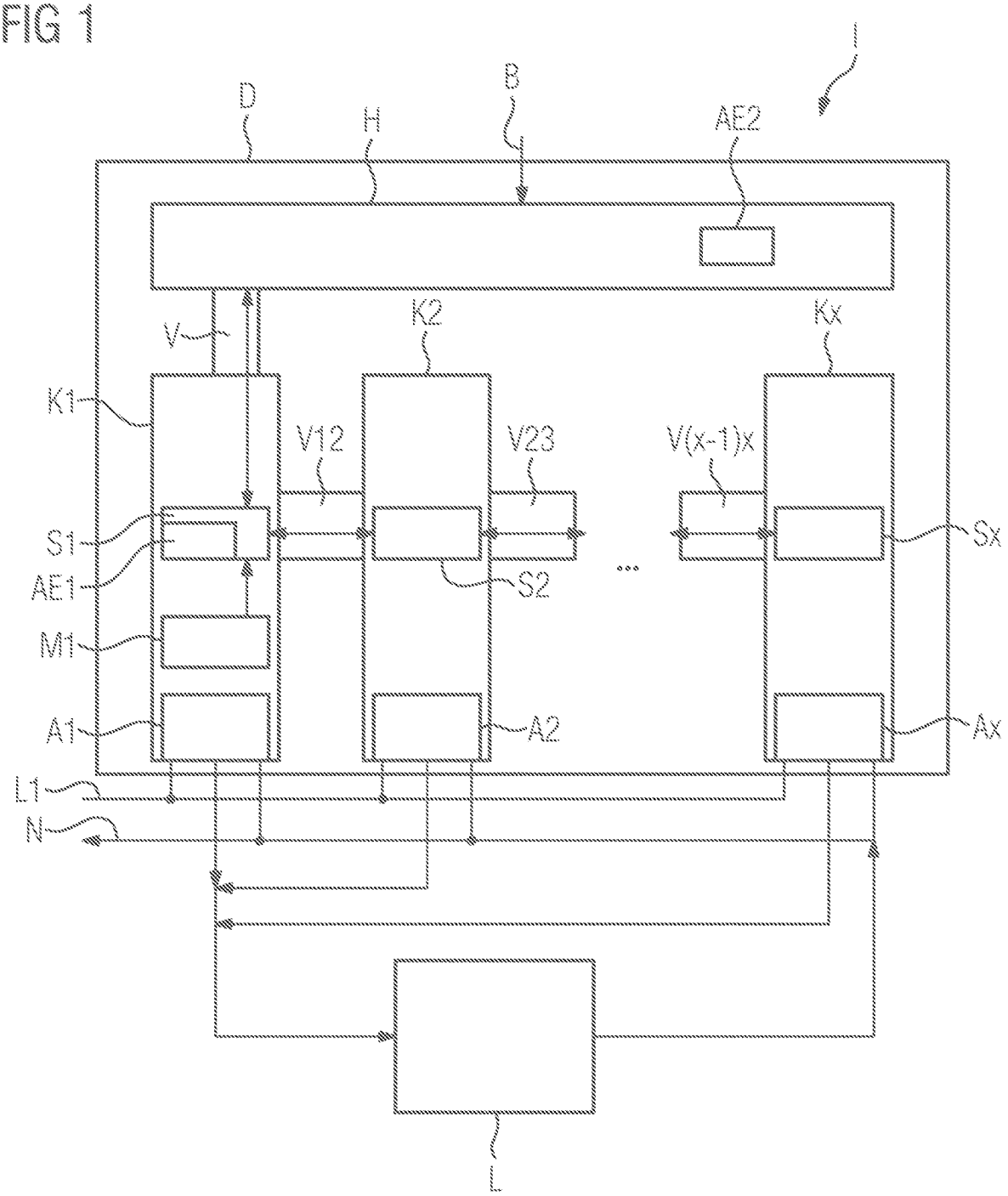
FIG. 1 shows the breakdown of functions of a first example of a multichannel dimmer incorporating teachings of the present disclosure.

In the case of a universal dimmer with a plurality of channels, each channel can only drive a given load (e.g. 300 W). If it is desired to drive a higher load (e.g. 1000 W), this is not possible with a single channel. For this reason, a plurality of channels are connected in parallel and thus jointly control a greater load. These parallel channels therefore on the one hand have to be controlled in parallel by the internal software and on the other have to be wired in parallel. If one of these two actions is not performed, this may lead to damage to the universal dimmer and the load. The teachings of the present disclosure include dimmers in which the parallel dimmer channels are controlled in parallel and, moreover, also correctly wired in parallel. Furthermore, an error in the form of incorrect wiring of the channels is immediately identified, such that no consequential damage occurs.

Each channel of the dimmer has information both about the times of the zero crossings of the sinusoidal AC voltage of the conductor connected thereto and about the zero crossings of the adjacent, parallel-connected channel. By measuring the phase shift of the two voltages, it is possible to establish whether an appreciable phase shift is present (error: different conductors connected) or not (no error: same conductor connected).

The various embodiments of the teachings herein reduce the probability of incorrect wiring or incorrect parameter setting in parallel operation. In the described error scenario, the error is identified automatically by the dimmer and reported (for example by an optical or acoustic signal, or by a corresponding error message on a display of the dimmer, or by a corresponding message to a central location (for example a system control center)). Damage to the dimmer and load by incorrect wiring/parameter setting of parallel operation is thereby made more difficult.

In some embodiments, a dimmer comprises at least two dimmer channels each with a channel control device. At least one of the dimmer channels is a measurement dimmer channel, because it comprises a measurement device for measuring the electricity in the channel. The information therefrom about the behavior of the electricity in the measurement dimmer channel is transmitted to the channel control device of the measurement dimmer channel. The dimmer further comprises a main control device, which may at least generate control commands for the dimmer channels, and a main communication link, which is at least suitable for transmitting such control commands from the main control device to the channel control device of a dimmer channel.

The dimmer further comprises at least one channel communication link from a first dimmer channel to a second dimmer channel, preferably with an element for electrical isolation of the first dimmer channel from the second dimmer channel, e.g. with an optocoupler or a transformer circuit. This channel communication link may transmit information, specifically at least about the behavior, e.g. the periodic behavior, of the electricity in the measurement dimmer channel, from the measurement device or indeed from the channel control device of a first dimmer channel to a second dimmer channel, e.g. to the channel control device of the second dimmer channel. The channel communication link may be also suitable for transmitting information in the reverse direction.

Because a communication link between each channel control device of the dimmer channels and a main control device of the dimmer is in any event required, e.g. including electrical isolation, it is possible with little additional effort to accommodate channel communication links between the channel control devices themselves, which may even replace some of the communication links between the channel control devices and the main control device of the dimmer.

The information about the periodic behavior of the electricity in a measurement dimmer channel may provide an indication of the time at which the information was sent by the channel control device of the first dimmer channel, or an indication of the time of at least one zero crossing of the voltage in the measurement dimmer channel. As a result of stored data, the channel control device of the second dimmer channel may, on the basis of the information about the periodic behavior of the electricity in the measurement dimmer channel, generate information about the periodic behavior of the electricity there with which it may switch the electricity in the channel accurately and synchronously with the other dimmer channels.

This stored data may include a time value, which equates to an estimate of the time for processing and transmitting the information from the measurement dimmer channel as far as the control device of the second dimmer channel. The time value is a constant for each dimmer channel and may contain values relating to the time for the generation of information by the measurement device, transmission thereof by the channel communication link or by the channel communication links from the measurement dimmer channel to the second dimmer channel and processing thereof in the dimmer channels. It can be determined for each dimmer channel, namely from a calibration with measurements at the dimmer or at other dimmers from the same type series or in a simulation using a computer. The data may be stored permanently in the channel control devices.

Because the signal is transmitted without complex processing over a short distance, the information about the periodic behavior of the electricity in the measurement dimmer channel arrives with little delay, but above all with a virtually identical delay in the case of repetition and despite aging of the components, at the channel control device of the second dimmer channel. It is worth noting that this even applies for the total transmission delay if the signal is transmitted from the original channel control device of the measurement dimmer channel via a number of channel control devices and via the channel communication links therebetween. Accordingly, the first dimmer channel in relation to a channel communication link may be a different one from the measurement dimmer channel.

In some embodiments, the channel communication link may at least also transmit control commands from the main control device from the channel control device of the first dimmer channel to the channel control device of the second dimmer channel. Thus, the instructions relating to switching behavior are also distributed in the same way to multiple dimmer channels, which makes direct communication links to the main control device of the dimmer superfluous. This too may take place unidirectionally for cost reasons, although bidirectional communication brings advantages.

In some embodiments, there is at least one channel communication link between the channel control device of the measurement dimmer channel and each channel control device of at least two dimmer channels. The measurement dimmer channel thus has a direct channel communication link with a plurality of control devices of other dimmer channels. This may be embodied as the same number of individual channel communication links, or indeed as a single channel communication link for bus communication or the like, according to which telegrams may be received at their destination thanks to an individual address or a group address.

In some embodiments, even the main control device is a channel control device.

To identify whether the respective times of the respective zero crossings of the sinusoidal AC voltage applied to the respective dimmer channel are substantially synchronous, the dimmer is equipped with a suitable evaluation unit (for example microcontroller with corresponding software or firmware) for evaluating the information about the behavior of the electricity in the dimmer channels. The evaluation unit may be arranged or integrated in the measurement dimmer channel and/or in the main control device.

In some embodiments, the measurement dimmer channel is set up to identify whether the respective times of the respective zero crossings of the sinusoidal AC voltages applied to the respective dimmer channels are substantially synchronous. If the sinusoidal AC voltages are substantially synchronous, synchronous switching of the dimmer channels is ensured and correct parallel wiring of the dimmer channels is identified. To identify this, one of the dimmer channels may be equipped as a measurement dimmer channel with the corresponding measuring instruments and evaluation means. The measurement dimmer channel is in this case in a channel communication link with the further parallel dimmer channels.

In some embodiments, each dimmer channel is set up to identify whether the respective times of the respective zero crossings of the sinusoidal AC voltages applied to the respective dimmer channels are substantially synchronous. If the sinusoidal AC voltages are substantially synchronous, synchronous switching of the dimmer channels is ensured and correct parallel wiring of the dimmer channels is identified. To identify this, each of the parallel dimmer channels may be equipped as a measurement dimmer channel with the corresponding measuring instruments and evaluation means.

In some embodiments, each dimmer channel is configured as a measurement dimmer channel with a respective measurement device and a respective communication link to the main control device, wherein the main control device is set up to identify whether the respective times of the respective zero crossings of the sinusoidal AC voltage applied to the respective dimmer channel are substantially synchronous. Based on the information provided by the dimmer channels about the respective periodic behavior of the electricity there, the main control device identifies whether synchronous switching of the dimmer channels and correct parallel wiring of the dimmer channels are present. The main control device is to this end equipped with corresponding evaluation means (e.g. means for comparing the information supplied), e.g. a microprocessor with corresponding software or firmware.

In some embodiments, there is a corresponding indicator (red LED, buzzing sound, output of a message on a display, etc.) at the dimmer on identification that the respective times of the respective zero crossings of the sinusoidal AC voltages applied to the respective dimmer channels are not synchronous. An error or malfunction in the connection of the dimmer is thereby communicated immediately to a user (e.g. installer).

Some embodiments include a dimmer for controlling the power consumption of a connectable load, in particular an LED light, having at least two parallel-connected, electrically isolated dimmer channels each with a channel control device, wherein each of the dimmer channels is configured as a measurement dimmer channel, in each case with a measurement device which is at least suitable for zero crossing identification of the current applied to the respective dimmer channel and/or of the respectively applied voltage; a main control device, which is set up to obtain information about the zero crossings of the sinusoidal alternating currents and/or AC voltages applied to the respective dimmer channels from the respective channel control devices via suitable communication links, and moreover is set up to compare the items of information about the zero crossings of the respective dimmer channels with one another, and moreover is set up to generate control commands for the dimmer channels, wherein, via the suitable communication links, the control commands may be transmitted from the main control device to the channel control devices of the dimmer channels, wherein the main control device is set up to identify whether the zero crossings of the dimmer channels allocated for parallel operation are substantially synchronous. Parallel operation of dimmer channels means that the dimmer channels are connected electrically to a common load and are wired appropriately therefor. The parallel dimmer channels must therefore switch in a time-synchronized manner.

In some embodiments, the main control device in the dimmer is configured as a separate component (for example microcontroller). In such embodiments, the channel control units or channel control devices may for example be of very inexpensive (lean) configuration. This enables simple command communication and simple power supply of the main control device and the channel control devices.

In some embodiments, the main control device is integrated into a correspondingly set-up channel control device of a dimmer channel. It is possible to dispense with a microcontroller. Furthermore, this enables direct and thus rapid communication between the dimmer channels.

In some embodiments, a channel control device of one dimmer channel is configured as a main control device as a master. In such embodiments, the channel control devices of the dimmer channels are substantially identical. Which of the channel control devices is the master is negotiable (it may for example depend on the production number or ID no.). In some embodiments, determination of the master proceeds automatically on start-up or on loading of the firmware.

In some embodiments, identification of whether the respective zero crossings of the sinusoidal alternating currents and/or AC voltages applied to the respective dimmer channels are substantially synchronous proceeds by comparing the respective times of the zero crossings or by comparing the respective phase angles. In some embodiments, this proceeds by measurement of the time difference between the zero crossovers. With a 50 Hz system, for example, there is a time difference of approximately 6.67 ms between two phases of a three-phase rotary current system, which corresponds to a phase angle of 120 degrees. With a 60 Hz system, for example, there is a time difference of approximately 5.55 ms.

In some embodiments, a corresponding indicator (red LED, buzzing sound, output of a message on a display, etc.) is activatable at the dimmer on identification that the respective times of the respective zero crossings of the sinusoidal alternating currents and/or AC voltages applied to the respective dimmer channels are not synchronous. A reliable message may for example be output if the measured time difference or a measured phase angle varies from the above-stated values by +/−5%.

Some embodiments include a method for identifying the correct wiring of at least two parallel-connected, electrically isolated dimmer channels of a dimmer, in particular a universal dimmer, wherein, for each dimmer channel, information about the times of the zero crossings of the sinusoidal AC voltage of the conductor connected thereto is provided as well as information about the zero crossings of the adjacent, parallel-connected channel; wherein, by measuring the phase shift of the two voltages, it is established whether or not an appreciable phase shift is present, wherein an identified phase shift represents incorrect wiring. The method may for example be performed on start-up of the dimmer. The method is advantageously performed automatically (or mandatorily) as a quality assurance measure on start-up of the dimmer.

FIG. 1 shows the breakdown of functions of a first example of a multichannel dimmer D on the supply network N, L1. The multichannel dimmer D has a plurality of electrically mutually isolated dimmer channels K1, K2, Kx each with a channel control device S1, S2, Sx. The dimmer channels K1, K2, Kx are connected on the output side in parallel via terminals A1, A2, Ax to the load L, so that each may feed a part of the current thereto.

The dimmer D starts as the result of an external command B. A main control device H generates control commands, which arrive via a communication link V at the channel control device S1 of the dimmer channel K1. The dimmer channel K1 contains a measurement device M1 which is suitable for generating information about the behavior of the electricity at one location in the channel, specifically information about the zero crossing of the voltage. The dimmer channel K1 is therefore also known as a measurement dimmer channel. In operation a communication link transmits such information from the measurement device M1 to the channel control device S1.

Starting from the measurement dimmer channel K1, a channel communication link V12, V23, V(x−1)x leads in each case from one dimmer channel to the next dimmer channel. In some embodiments, these channel communication links V12, V23, V(x−1)x are suitable for transmitting information about the behavior of the electricity in the measurement dimmer channel K1 to the channel control device S2, Sx of the next dimmer channel K2, Kx, and here specifically from the channel control device S1, S2 of the one dimmer channel K1, K2 to the channel control device S2, Sx of the other dimmer channel K2, Kx.

Furthermore, these channel communication links V12, V23, V(x−1)x can also carry convey on the control commands from the main control device H. The communication links V, V12, V23, V(x−1)x between the electrically isolated main control device H and the dimmer channels K1, K2, Kx each contain an optocoupler on each side.

Figure 2:
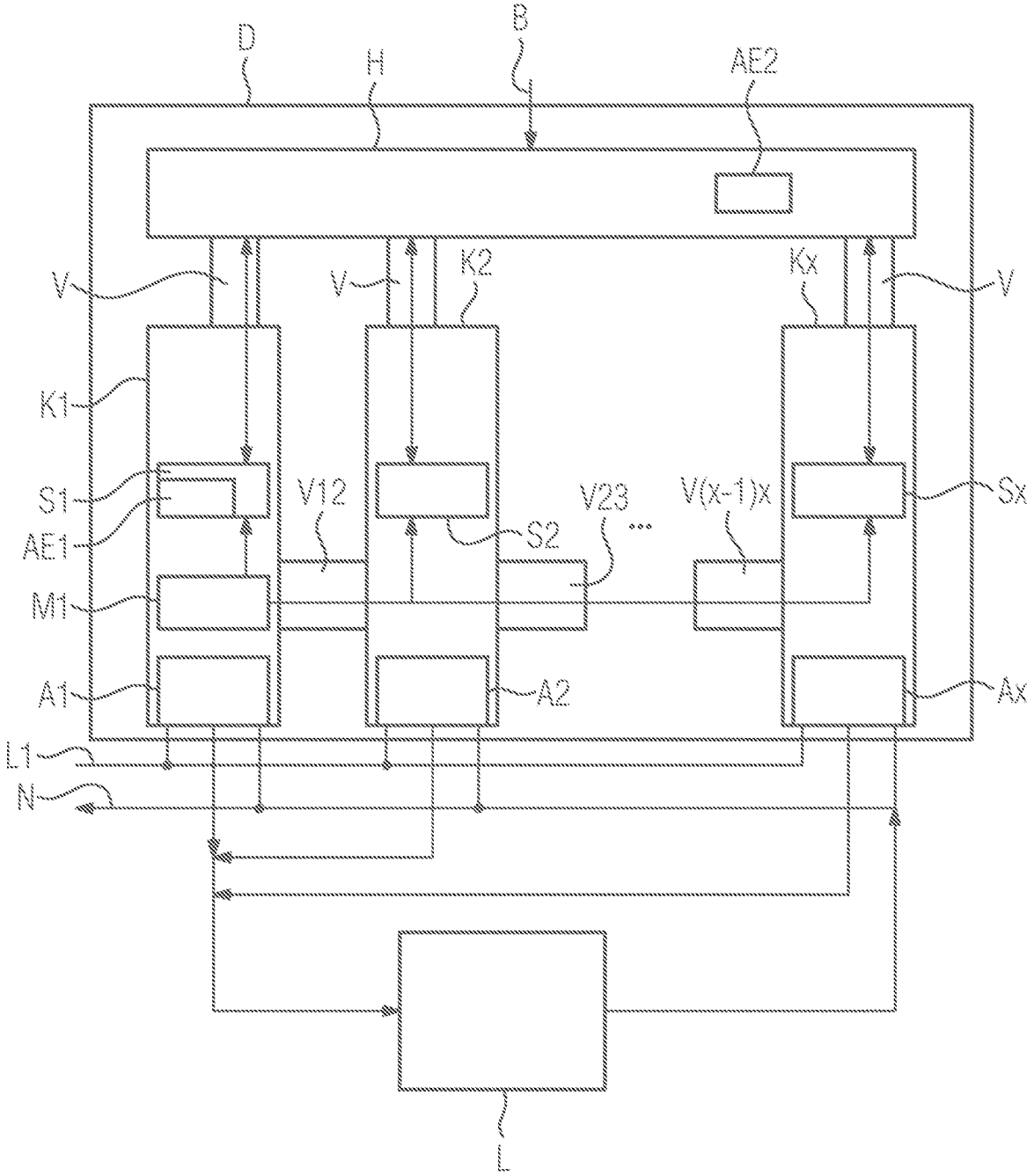
FIG. 2 shows the breakdown of functions of a second example of a multichannel dimmer incorporating teachings of the present disclosure.

FIG. 2 shows a second example of a multichannel dimmer. In the variant in FIG. 2, the channel communication links V12, V23, V(x−1)x between the dimmer channels K1, K2, Kx link the measurement device M with the respective channel control devices S1, S2, Sx for very prompt transmission. The channel communication links V12, V23, V(x−1)x are unidirectional, and therefore separate communication links V deliver the control commands from the main control device H to each dimmer channel K1, K2, Kx and return any feedback.

Figure 3:
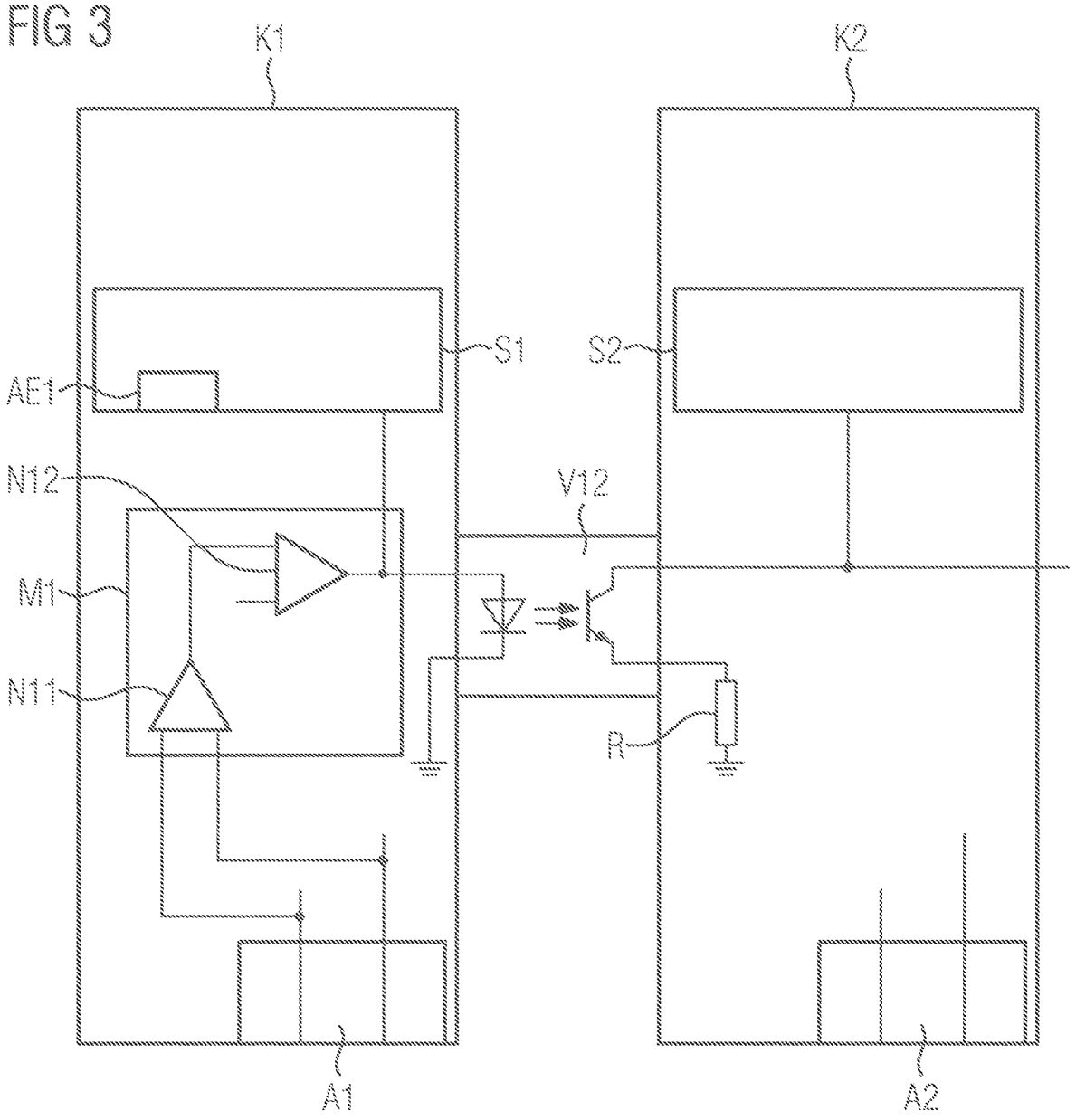
FIG. 3 shows simplified circuits of two dimmer channels and the associated channel communication link for the second example of a multichannel dimmer from FIG. 2.

FIG. 3 shows measurement dimmer channel K1, dimmer channel K2 and the channel communication link V12 thereof of the second example of the multichannel dimmer according to FIG. 2, wherein the circuits of the measurement device M1, the channel communication link V12 and the dimmer channel K2 are shown in simplified form. An operational amplifier N11 of the measurement device M1 transforms the line voltage from 230 volts into a more readily processed signal. A comparator N12 of the measurement device M1 analyzes this signal for zero crossings. The zero crossings are passed on directly to the channel control device S1, and also to an optocoupler in the channel communication link V12. For the purpose of electrical isolation, the optocoupler contains a light-emitting diode and a photosensitive resistor, which connect a current via the resistor R in the dimmer channel K2. The optocoupler thus transmits the information relating to the zero crossovers with little delay to the channel control device S2 and to the next channel communication link.

The measurement device M1 may itself also act as an evaluation unit, i.e. assume or provide an evaluation functionality, such as phase angle comparison and/or zero crossing time comparison. That is to say, the functionalities of the measurement device M1 and the evaluation unit AE1 may be incorporated into one element or component. The evaluation functionalities may however also be embodied in a separate evaluation unit AE1.

In some embodiments, the control commands from the main control device H, as in the variant of FIG. 1, arrive via a single communication link V at the channel control device S1 of the dimmer channel K1. However, the channel control device S1 passes them on to next dimmer channel K2 via the channel communication links V12, as in the variant of FIG. 2. To this end, however, such channel communication links V12, V23, V(x−1)x depicted in FIG. 3 are for example supplemented upstream of the light-emitting diode with a switch and a resistor in series relative to ground. The switch, for example a transistor, is switched between conductive and blocking by an output of the respective channel control device Sx. When the respective comparator Nx2 energizes the light-emitting diode, the switch may thus impose small voltage steps on the signal, which lead to small intensity steps in the light of the light-emitting diode. The corresponding resistance steps in the photosensitive resistor on the receiver side may be perceived by a simple voltmeter. However, they do not there trigger zero crossing detection. These steps thus encode the control commands of the main control device H and are passed on by the voltmeter to the respective channel control device Sx+1.

To identify whether the respective times of the respective zero crossings of the sinusoidal AC voltage applied to the respective dimmer channel K1, K2, Kx are substantially synchronous, the exemplary dimmers D according to FIG. 1 or according to Figure are equipped with a suitable evaluation unit AE1, AE2 (e.g. microcontroller with corresponding software or firmware) for evaluating the information about the behavior of the electricity in the dimmer channels K1, K2, Kx. Evaluation proceeds for example by comparing the respective times of the respective zero crossings of the sinusoidal AC voltages applied to the respective dimmer channels K1, K2, Kx or by analyzing the respective phase shift angles or the phase difference.

The evaluation unit AE1, AE2 may be arranged or integrated in the measurement dimmer channel M1 and/or in the main control device H.

In some embodiments, each dimmer channel K1, K2, Kx is configured as a measurement dimmer channel M1 with a respective measurement device M1 and a respective communication link V to the main control device H, wherein the main control device H is set up to identify whether the respective times of the respective zero crossings of the sinusoidal AC voltage applied to the respective dimmer channel K1, K2, Kx are substantially synchronous. Based on the information provided by the parallel dimmer channels K1, K2, Kx about the respective periodic behavior of the electricity there, the main control device H identifies whether synchronous switching of the dimmer channels K1, K2, Kx and correct parallel wiring of the dimmer channels K1, K2, Kx are present. The main control device H is to this end equipped with corresponding evaluation means AE2 (e.g. means for comparing the delivered information), e.g. a microprocessor with corresponding software or firmware. In principle, each dimmer channel K1, K2, Kx may thus have an evaluation unit AE1.

In some embodiments, there is a corresponding indicator I (red LED, buzzing sound, output of a message on a display, etc.) at the dimmer D on identification that the respective times of the respective zero crossings of the sinusoidal AC voltages applied to the respective dimmer channels K1, K2, Kx are not synchronous. An error or malfunction in the connection of the dimmer D is thereby communicated immediately to a user (e.g. installer).

Figure 4:
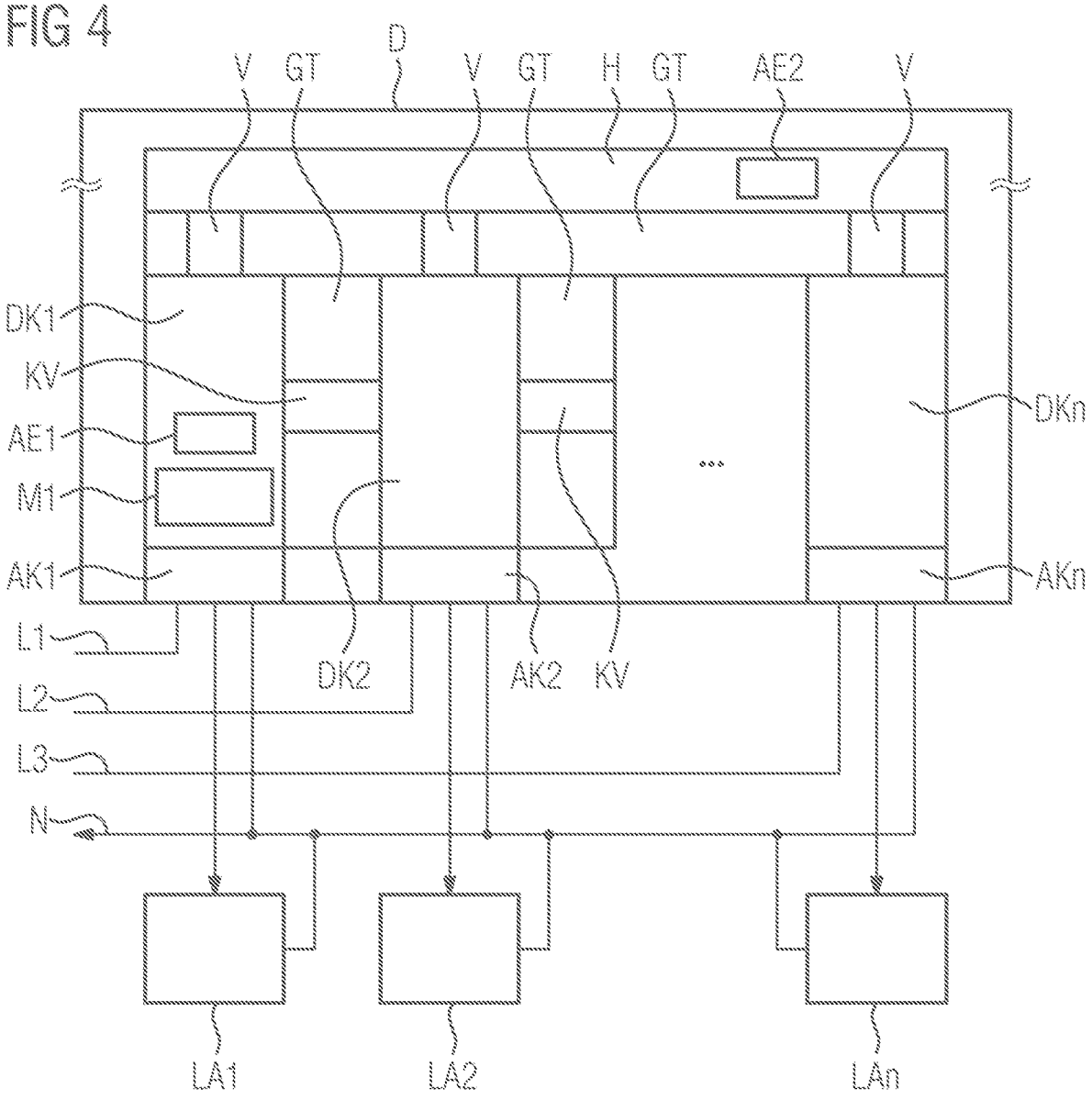
FIG. 4 shows an arrangement for a third example of a multichannel dimmer incorporating teachings of the present disclosure.

FIG. 4 shows an arrangement for a third example of a multichannel dimmer D. The exemplary multichannel dimmer D according to FIG. 4 comprises a universal dimmer. In the case of a universal dimmer with a plurality of channels DK1-DKn, each channel can only drive a given load LA1-LAn (e.g. 300 W). If it is desired to drive a higher load (e.g. 1000 W), this is not possible with a single channel. For this reason, a plurality of channels DK1-DKn are connected in parallel and thus jointly control a greater load. These parallel channels DK1-DKn therefore on the one hand have to be controlled in parallel by the internal software and on the other have to be wired in parallel.

If one of these two actions is not performed, this may lead to damage to the universal dimmer and the load. The universal dimmer D comprises a main control device H (e.g. a suitably set-up microcontroller), which is at least suitable for generating control commands for the dimmer channels DK1-DKn. Control commands may be transmitted via the communication link V from the main control device H to the corresponding channel control devices of the respective dimmer channels DK1-DKn. The parallel-connected, electrically isolated (GT) dimmer channels DK1-DKn are advantageously each equipped with a channel control device (simple processor or correspondingly set-up microprocessor). Information may be transmitted between the dimmer channels DK1-DKn, in particular between two adjacent dimmer channels, via channel communication links KV.

In some embodiments, at least one dimmer channel DK1 comprises a corresponding measurement device M1 and a corresponding evaluation unit AE1. The evaluation unit AE1 is set up to identify whether the respective times of the respective zero crossings of the sinusoidal AC voltage applied to the respective dimmer channel DK1-DKn are substantially synchronous. In some embodiments, further or indeed all dimmer channels DK1-DKn may be equipped with a measurement device M1 and an evaluation unit AE1. The main control device H may also comprise a correspondingly set-up evaluation unit AE2, for identifying whether the respective times of the respective zero crossings of the sinusoidal AC voltage applied to the respective dimmer channel DK1-DKn are substantially synchronous. The dimmer channels DK1-DKn are connected on the output side for current feed via terminals AK1-AKn to the corresponding load LA1-LAn.

Although the dimmer D comprises a complete device, it may have independent, electrically isolated (GT) channels DK1-DKn (=load outputs). Different phases L1, L2, L3 may therefore of course be connected thereto (e.g. L1 to channel DK1, L2 to channel DK2 etc.), so as in each case to drive independent loads LA1, LA2, LAn. Each channel DK1-DKn may drive a specific maximum load (e.g. 300 W).

From a software point of view, it is also possible to bundle two or more channels, in order jointly to drive a load which is greater than the maximum load of an individual channel DK1-DKn (e.g. 1000 W). If this is the case, all of channels DK1-DKn have of course to be connected to the same phase (see dimmer arrangement according to FIG. 5).

Figure 5:
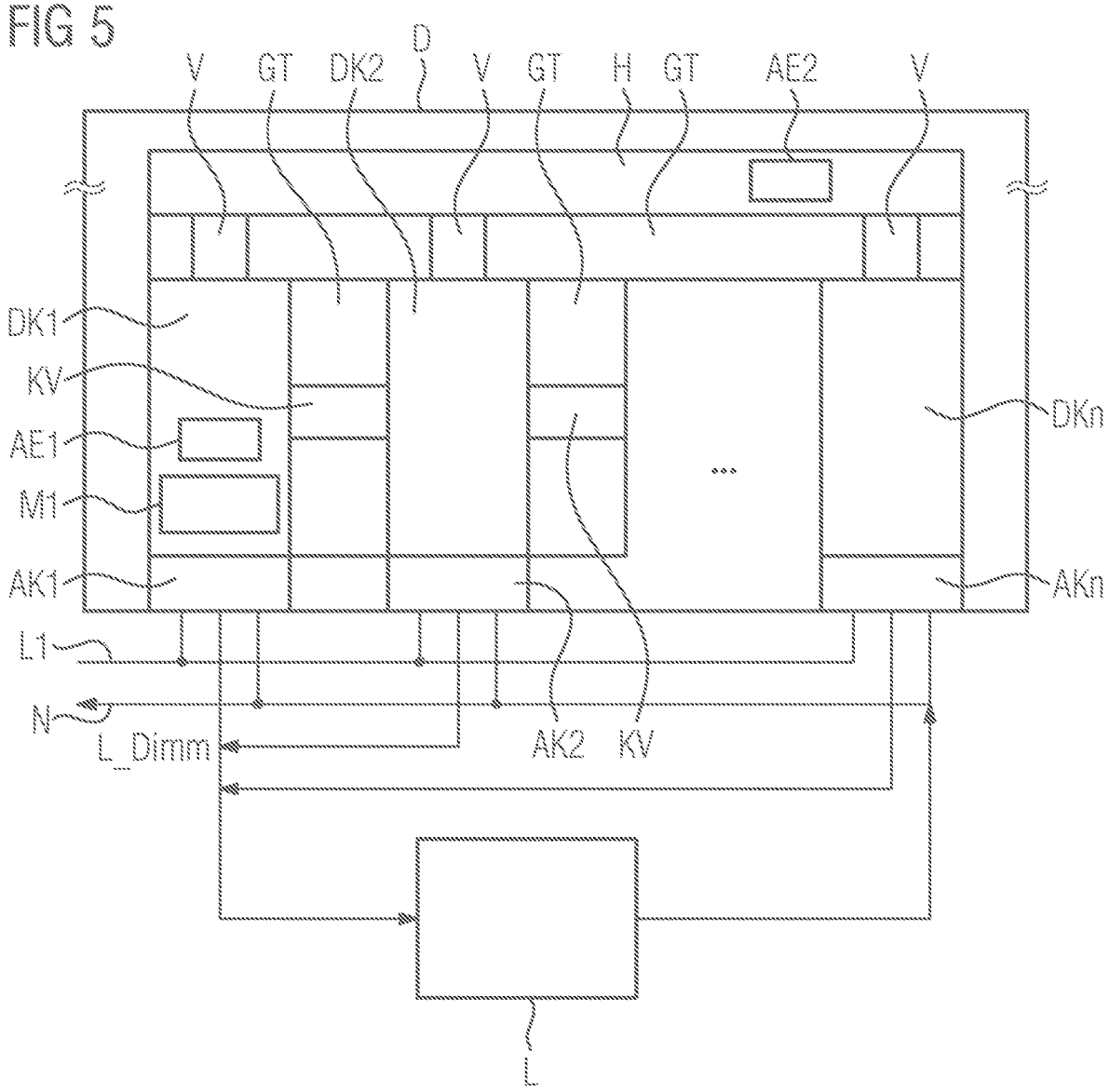
FIG. 5 shows an arrangement for a fourth example of a multichannel dimmer incorporating teachings of the present disclosure.

FIG. 5 shows an arrangement for a fourth example of a multichannel dimmer D in which all of channels DK1-DKn are connected to the same phase L1. It is thus possible from a software point of view (by way of corresponding phase or zero crossing synchronization, e.g. by way of corresponding synchronization signals of the control unit H to the channels DK1-DKn) to bundle two or more channels DK1-DKn so as jointly to drive a load L which is greater than the maximum load of an individual channel DK1-DKn. If, on the other hand, different phases are connected to bundled channels (see dimmer arrangement according to FIG. 6), both the dimmer and the load may be damaged.

Figure 6:
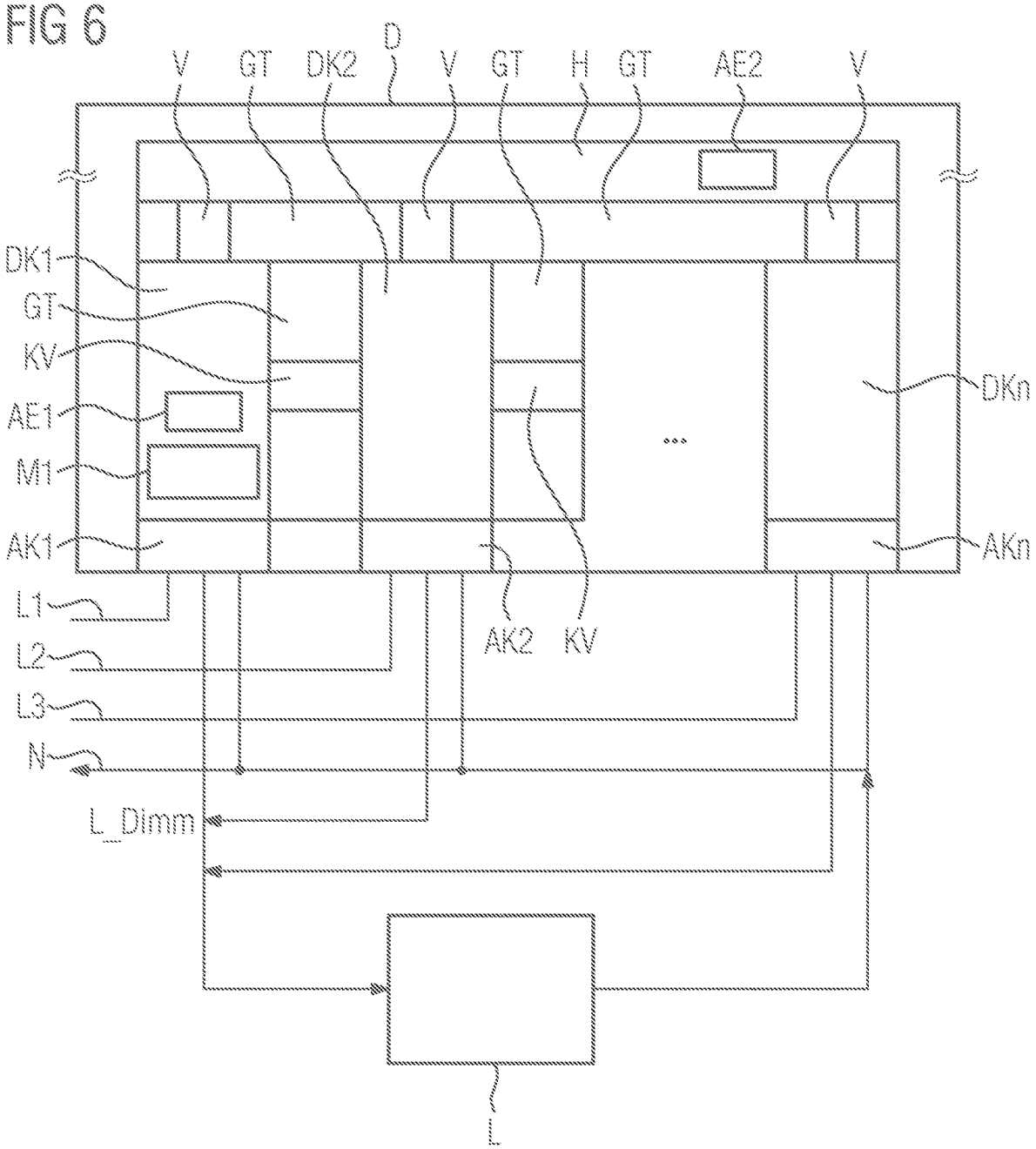
FIG. 6 shows an arrangement for a fifth example of a multichannel dimmer incorporating teachings of the present disclosure.

FIG. 6 shows an arrangement for a fifth example of a multichannel dimmer D, wherein different phases L1, L2, L3 are connected to bundled channels DK1-DKn. With the connection arrangement according to FIG. 6, both the dimmer D and the load L (e.g. a lamp) may be damaged. It is therefore necessary to identify and report incorrect wiring (=different phases L1, L2, L3 on bundled channels DK1-DKn).

Figure 7:
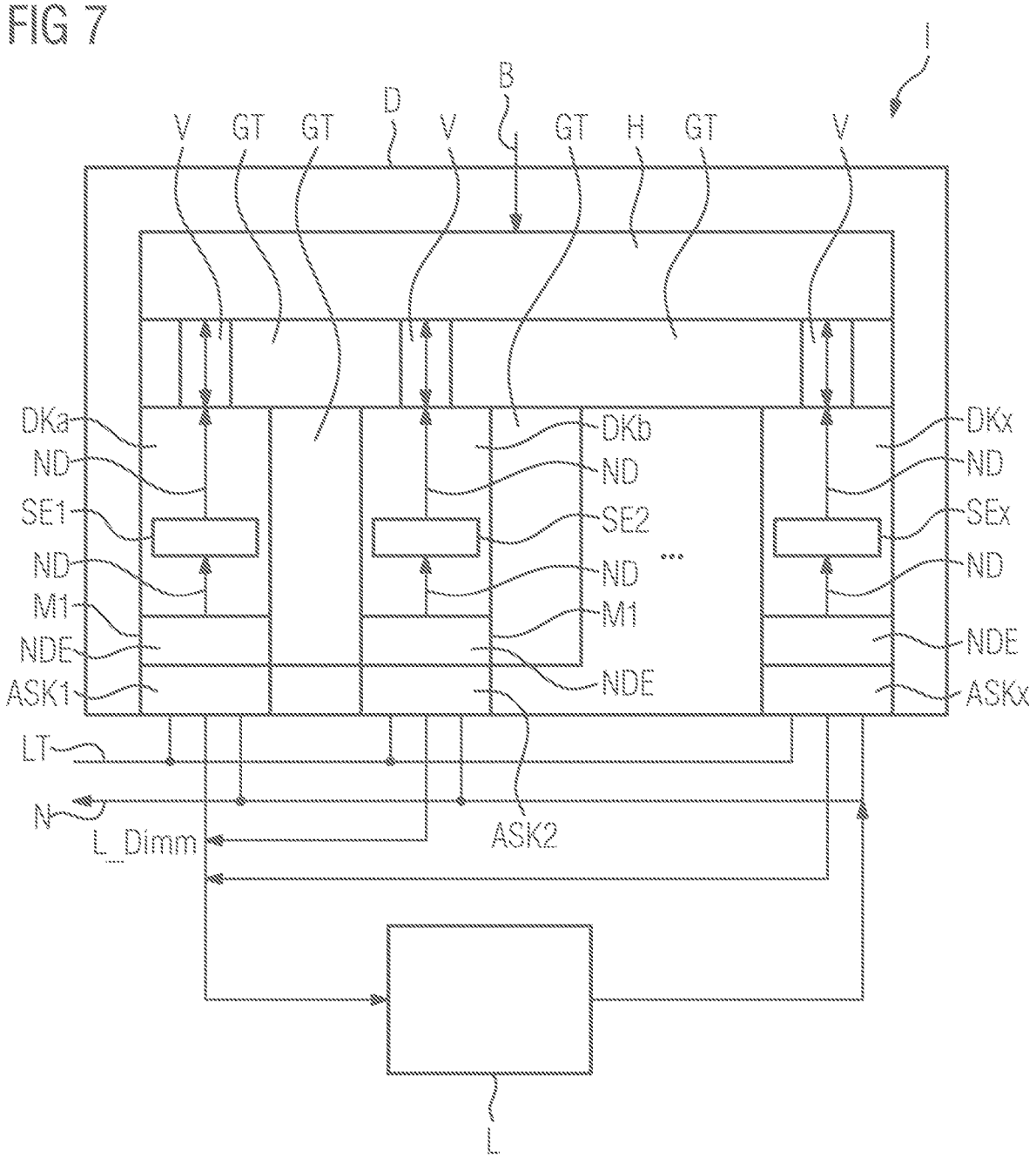
FIG. 7 shows an arrangement for a sixth example of a multichannel dimmer incorporating teachings of the present disclosure.

FIG. 7 shows an arrangement for a sixth example of a multichannel dimmer. The exemplary multichannel dimmer D according to FIG. 7 is also a universal dimmer. In the case of a universal dimmer with a plurality of channels DKa-DKx, each channel can only drive a given load (e.g. 300 W). If it is desired to drive a higher load L (e.g. 1000 W), this is not possible with a single channel. For this reason, a plurality of channels DKa-DKx are connected in parallel and so jointly control a greater load L (e.g. a light). These parallel channels DKa-DKx therefore on the one hand have to be controlled in parallel by the internal software and on the other have to be wired in parallel. If one of these two actions is not performed, this may lead to damage to the universal dimmer D and the load L.

The exemplary dimmer D for controlling the power consumption of a connectable load L, in particular an LED light, according to Figure comprises: at least two parallel-connected, electrically isolated GT dimmer channels DKa-DKx each with one channel control device SE1-SEx, wherein each of the dimmer channels DKa-DKx is configured as a measurement dimmer channel, with in each case one measurement device M1, which is at least suitable for zero crossing identification NDE of the current applied to the respective dimmer channel DKa-DKx and/or the respectively applied voltage; a main control device H, which is set up to obtain information about the zero crossings ND of the sinusoidal alternating currents and/or AC voltages applied to the respective dimmer channels DKa-DKx from the respective channel control devices SE1-SEx via suitable communication links V, and which is further set up to compare the items of information about the zero crossings (ND) of the respective dimmer channels DKa-DKx with one another, and which is further set up to generate control commands for the dimmer channels DKa-DKx, wherein the control commands may be transmitted via the suitable communication links V from the main control device H to the channel control devices SE1-SEx of the dimmer channels DKa-DKx; wherein the main control device H is set up to identify whether the zero crossings of the dimmer channels DKa-DKx allocated for parallel operation are substantially synchronous.

In the case of dimmer D according to FIG. 7, the main control device H in the dimmer D is configured as a separate component (e.g. microcontroller). In this embodiment, the channel control units SE1-SEx or channel control devices may for example be of very inexpensive (lean) configuration. This embodiment enables simple command communication and simple power supply of the main control device H and the channel control devices SE1-SEx.

With the dimmer D according to FIG. 7 identification as to whether the respective zero crossings ND of the sinusoidal alternating currents and/or AC voltages applied to the respective dimmer channels DKa-DKx are substantially synchronous proceeds by comparing the respective times of the zero crossings ND or by comparing the respective phase angles in the main control device H. This may proceed by measuring the time difference of the zero crossings. With a 50 Hz system, for example, there is a time difference of approximately 6.67 ms between two phases of a three-phase rotary current system, which corresponds to a phase angle of 120 degrees. With a 60 Hz system, for example, there is a time difference of approximately 5.55 ms. In the event of identification that the respective times of the respective zero crossings ND of the sinusoidal alternating currents and/or AC voltages applied to the respective dimmer channels DKa-DKx are not synchronous, a corresponding indicator I (red LED, buzzing sound, output of a message on a display, etc.) is activatable at the dimmer D. A reliable message may be output by the indicator I for example if the measured time difference or a measured phase angle varies around the above-stated values by +/−10%, in particular by +/−5%.

Figure 8:
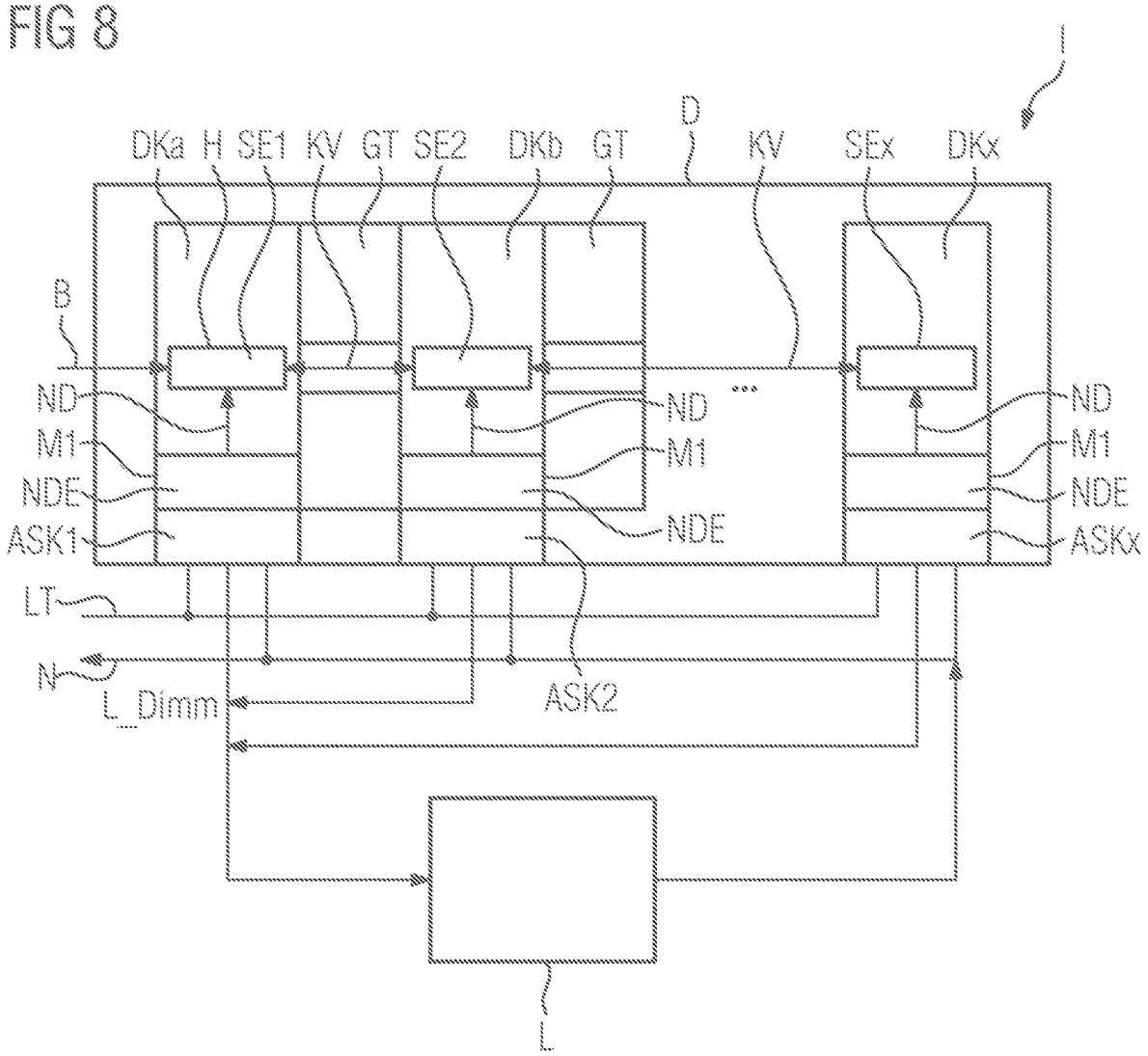
FIG. 8 shows an arrangement for a seventh example of a multichannel dimmer incorporating teachings of the present disclosure.

FIG. 8 shows an arrangement for a seventh example of a multichannel dimmer D. The multichannel dimmer D according to FIG. 8 also comprises a universal dimmer. In the case of a universal dimmer with a plurality of channels DKa-DKx, each channel can only drive a given load (e.g. 300 W). If it is desired to drive a higher load L (e.g. 1000 W), this is not possible with a single channel. For this reason, a plurality of channels DKa-DKx are connected in parallel and so jointly control a greater load L (e.g. a light). These parallel channels DKa-DKx therefore on the one hand have to be controlled in parallel by the internal software and on the other have to be wired in parallel. If one of these two actions is not performed, this may lead to damage to the universal dimmer D and the load L.

The exemplary dimmer D for controlling the power consumption of a connectable load L, in particular an LED light, according to Figure comprises: at least two parallel-connected, electrically isolated GT dimmer channels DKa-DKx each with one channel control device SE1-SEx, wherein each of the dimmer channels DKa-DKx is configured as a measurement dimmer channel, with in each case one measurement device M1, which is at least suitable for zero crossing identification NDE of the current applied to the respective dimmer channel DKa-DKx and/or the respectively applied voltage; a main control device H, which is set up to obtain information about the zero crossings ND of the sinusoidal alternating currents and/or AC voltages applied to the respective dimmer channels DKa-DKx from the respective channel control devices SE1-SEx via suitable communication links KV, and which is further set up to compare the items of information about the zero crossings (ND) of the respective dimmer channels DKa-DKx with one another, and which is further set up to generate control commands for the dimmer channels DKa-DKx, wherein the control commands may be transmitted via the suitable communication links KV from the main control device H to the channel control devices SE1-SEx of the dimmer channels DKa-DKx; wherein the main control device H is set up to identify whether the zero crossings of the dimmer channels DKa-DKx allocated for parallel operation are substantially synchronous.

With the dimmer D according to FIG. 8, the functionality of the main control device may be integrated into a correspondingly set-up channel control device SE1-SEx of a dimmer channel DKa-DKx. In this embodiment it is possible to dispense with a microcontroller. Moreover, this embodiment enables direct and thus rapid communication between the channel control devices SE1-SEx of the dimmer channels DKa-DKx. With the exemplary dimmer D according to FIG. 8, a channel control device SE1-SEx of one of the dimmer channels DKa-DKx may be configured as a main control device, i.e. as a master.

With this embodiment the channel control devices SE1-SEx of the dimmer channels DKa-DKx are substantially identical. Which of the channel control devices SE1-SEx is the master (master dimmer channel) is negotiable (it may for example depend on the production number or ID no.). In some embodiments, determination of the master proceeds automatically on start-up or on loading of the firmware.

With the dimmer D according to FIG. 8, identification as to whether the respective zero crossings ND of the sinusoidal alternating currents and/or AC voltages applied to the respective dimmer channels DKa-DKx are substantially synchronous proceeds in the master dimmer channel by comparing the respective times of the zero crossings ND or by comparing the respective phase angles. In the event of identification that the respective times of the respective zero crossings ND of the sinusoidal alternating currents and/or AC voltages applied to the respective dimmer channels DKa-DKx are not synchronous, a corresponding indicator I is activatable at the dimmer D. In principle, a corresponding message may also be output to a central location within a building automation system.

Figure 9:
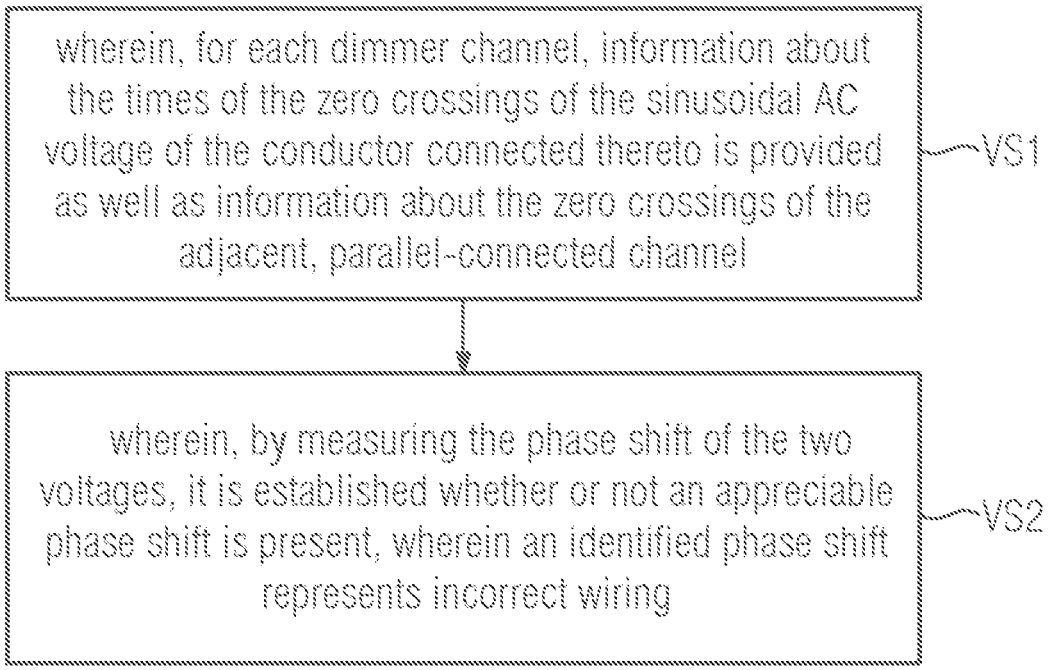
FIG. 9 shows an example of a flow chart for a method for identifying the correct wiring of at least two parallel-connected, electrically isolated dimmer channels of a dimmer, e.g. a universal dimmer, incorporating teachings of the present disclosure.

FIG. 9 shows an exemplary flow chart for a method for identifying the correct wiring of at least two parallel-connected, electrically isolated dimmer channels of a dimmer, in particular a universal dimmer, (VS1) wherein, for each dimmer channel, information about the times of the zero crossings of the sinusoidal AC voltage of the conductor connected thereto is provided as well as information about the zero crossings of the adjacent, parallel-connected channel; and (VS2) wherein, by measuring the phase shift of the two voltages, it is established whether or not an appreciable phase shift is present, wherein an identified phase shift represents incorrect wiring. Identified incorrect wiring may be displayed or indicated by the dimmer optically (flashing light and/or message text output on a display on the dimmer housing) and/or acoustically (for example warning sound).

Using the method according to FIG. 9 enables damage due to incorrect wiring to be avoided both for the dimmer D and the load (e.g. a lamp). Each channel of the dimmer has information both about the times of the zero crossings of the sinusoidal AC voltage of the conductor connected thereto and about the zero crossings of the adjacent, parallel-connected channel. By measuring the phase shift of the two voltages, it is possible to establish whether an appreciable phase shift is present (error: different conductors connected) or not (no error: same conductor connected).

The teachings herein reduce the probability of incorrect wiring or incorrect parameter setting in parallel operation of a dimmer. In the described error scenario, the error is identified automatically by the dimmer and reported. Damage to the dimmer and load by incorrect wiring/parameter setting of parallel operation is thereby made more difficult or even prevented.

Some embodiments include a method and corresponding dimmer for identifying the correct wiring of at least two parallel-connected electrically isolated dimmer channels of a dimmer, in particular a universal dimmer, wherein, for each dimmer channel, information about the times of the zero crossings of the sinusoidal AC voltage of the conductor connected thereto is provided as well as information about the zero crossings of the adjacent, parallel-connected channel; and wherein, by measuring the phase shift of the two voltages, it is established whether or not an appreciable phase shift is present, wherein an identified phase shift represents incorrect wiring.

REFERENCE SIGNS

D Dimmer
B Command
H Main control device
V Communication link
K1-Kx, DK1-DKn, DKa-DKx Dimmer channel
S1-Sx, SE1-SEx Channel control device
M1 Measurement device
N11 Operational amplifier
N12 Comparator
AE1, AE2 Evaluation unit
R Resistor
V12, V23, V(x−1)x, KV Channel communication link
A1-Ax, AK1-Akn, ASK1-ASKx Terminal
L, LA1-LAn Load
N Neutral conductor
L1, L2, L3, PS Phase conductor
L_Dimm Dimming load
GT Electrical isolation
NDE Zero crossing identification
ND Zero crossing
I Indicator
VS1-VS2 Method step

The invention claimed is:

1. A dimmer for controlling the power consumption of a connectable load, the dimmer comprising:

two parallel-connected, electrically isolated dimmer channels each with a respective channel control device, wherein at least one of the two dimmer channels comprises a measurement dimmer channel having a measurement device generating information about behavior of the electricity at a location in the measurement dimmer channel;

a main control device generating control commands for the two dimmer channels;

a communication link transmitting control commands from the main control device to the respective channel control device of the two dimmer channels; and a channel communication link transmitting information from a first dimmer channel to a second dimmer channel;

wherein the channel communication link further transmits information about the behavior of the electricity at the location in the measurement dimmer channel;

starting from the measurement dimmer channel, a channel communication link leads in each case from one dimmer channel to the next dimmer channel; and the dimmer determines whether respective times of respective zero crossings of a sinusoidal AC voltage applied to the respective dimmer channel are substantially synchronous.

2. The dimmer as claimed in claim 1, wherein the channel communication link transmits information to the respective channel control device of the second dimmer channel.

3. The dimmer as claimed in claim 1, wherein the information includes an indication about a time of a zero crossing of the voltage at the location in the measurement dimmer channel.

4. The dimmer as claimed in claim 1, wherein the respective channel control device of the second dimmer channel generates, as a result of stored data, information based at least in part on the information about the behavior of the electricity at a location in the second dimmer channel.

5. The dimmer as claimed in claim 4, wherein the data includes a time value corresponding to an estimate of a time for processing and transmitting the information from the measurement dimmer channel as far as the control device of the second dimmer channel.

6. The dimmer as claimed in claim 4, wherein the information about the behavior of the electricity at the location in the second dimmer channel includes an indication about a time a zero crossing of the voltage.

7. The dimmer as claimed in claim 1, wherein the channel communication link transmits control commands from the main control device and the respective channel control device of the first dimmer channel to the respective channel control device of the second dimmer channel.

8. The dimmer as claimed in claim 1, wherein the channel communication link comprises an element for electrical isolation of the first dimmer channel from the second dimmer channel.

9. The dimmer as claimed in claim 1, wherein the main control device comprises a channel control device.

10. The dimmer as claimed in claim 1, wherein the first dimmer channel is separate from the measurement dimmer channel.

11. The dimmer as claimed in claim 1, wherein at least two channel communication links are suitable in each case for transmitting information about behavior of the electricity in the measurement dimmer channel from the measurement dimmer channel to at least two other dimmer channels.

12. The dimmer as claimed in claim 1, wherein the measurement dimmer channel identifies whether respective times of the respective zero crossings of the sinusoidal AC voltages applied to the respective dimmer channels are substantially synchronous.

13. The dimmer as claimed in claim 1, wherein each dimmer channel identifies whether respective times of the respective zero crossings of sinusoidal AC voltages applied to the respective dimmer channels are substantially synchronous.

14. The dimmer as claimed in claim 1, wherein:

each dimmer channel comprises a respective measurement dimmer channel with a respective measurement device and a respective communication link to the main control device;

the main control device identifies whether respective times of the respective zero crossings of a sinusoidal AC voltage applied to the respective dimmer channel are substantially synchronous.

15. The dimmer as claimed in claim 1, wherein in the event of identification that the respective times of the respective zero crossings of the sinusoidal AC voltages applied to the respective dimmer channels are not synchronous, a corresponding indicator is activated at the dimmer.

16. A dimmer for controlling the power consumption of a connectable load, the dimmer comprising:

two parallel-connected, electrically isolated dimmer channels each with a respective channel control device wherein each of the two dimmer channels comprises a measurement dimmer channel with a respective measurement device for identifying zero crossings of a current applied to the respective dimmer channel and/or an applied voltage;

a main control device to obtain information about the zero crossings of sinusoidal alternating currents and/or AC voltages applied to the respective dimmer channels from the respective channel control devices via communication links;

wherein the main control device compares the items of information about the zero crossings of the respective dimmer channels with one another, and wherein the main control device generates control commands for the dimmer channels, wherein the control commands are transmitted via the communication links from the main control device to the channel control devices of the dimmer channels;

wherein the main control device identifies whether the zero crossings of the dimmer channels allocated for parallel operation are substantially synchronous.

17. The dimmer as claimed in claim 16, wherein the main control device comprises a separate device.

18. The dimmer as claimed in claim 16, wherein the main control device is integrated into a corresponding channel control device.

19. The dimmer as claimed in claim 16, wherein a channel control device of one dimmer channel comprises the main control device or a master control device.

20. The dimmer as claimed in claim 16, wherein identification as to whether the respective zero crossings of the sinusoidal alternating currents and/or AC voltages applied to the respective dimmer channels are substantially synchronous includes comparing respective times of the zero crossings or by comparing respective phase angles.

21. The dimmer as claimed in claim 16, wherein in the event of identification that the respective times of the respective zero crossings of the sinusoidal alternating currents and/or AC voltages applied to the respective dimmer channels are not synchronous, a corresponding indicator is activated at the dimmer.

* * * * *